US005421567A

United States Patent [19]

Bolza-Schünemann

[11] Patent Number: 5,421,567

[45] Date of Patent: Jun. 6, 1995

[54] SYNCHRONIZED WEB-FED ROTARY PRINTING PRESSES WITH INSERTING DRUM

[75] Inventor: Hans-Bernhard Bolza-Schünemann, Würzburg, Germany

[73] Assignee: Koenig & Bauer Aktiengesellschaft, Wurzburg, Germany

[21] Appl. No.: 222,311

[22] Filed: Mar. 28, 1994

Related U.S. Application Data

[63] Continuation of Ser. No. 936,701, Aug. 31, 1992, abandoned.

[30] Foreign Application Priority Data

Aug. 26, 1992 [DE] Germany ..... 42 28 280.2

[51] Int. Cl.[6] ..... B41F 13/58; B65H 5/30

[52] U.S. Cl. ..... 270/9; 270/17; 270/55

[58] Field of Search ..... 270/4, 5, 6, 7, 11, 270/18, 19, 20.1, 21.1, 54, 55, 10, 8, 9, 17

[56] References Cited

U.S. PATENT DOCUMENTS

| | | | |
|---|---|---|---|
| 837,345 | 12/1906 | Schmidt | 270/5 |
| 1,727,426 | 9/1929 | Brueshaber | 270/8 |
| 1,848,591 | 3/1932 | Wood | 270/6 |
| 1,924,584 | 8/1933 | Wood | 270/5 |
| 2,423,028 | 6/1947 | Horton et al. | 270/5 |
| 2,463,769 | 3/1949 | Higgins | 270/4 |
| 2,673,315 | 3/1954 | Seeger | 270/5 X |
| 3,822,877 | 7/1974 | Littleton . | |
| 4,079,928 | 3/1978 | Weschenfelder et al. | 270/55 |
| 5,019,716 | 5/1991 | Meier et al. | 270/54 X |

*Primary Examiner*—John E. Ryznic
*Attorney, Agent, or Firm*—Jones, Tullar & Cooper

[57] ABSTRACT

Two or more web-fed rotary printing press sections of a web-fed rotary printing press with usual printing units, reel stands, web-leads produce synchronously signatures with longitudinal and cross fold which are supplied to an inserting device of the web-fed rotary printing press for being gathered there to a printed product of many pages and then delivered to a transporting system.

3 Claims, 7 Drawing Sheets

2x48 Pages [2] [70000 Copies/h]

2x96 Pages [2] [70000 Copies/h]

2x48 Pages [2] [70000 Copies/h]

SYNCHRONIZED WEB-FED ROTARY PRINTING PRESSES WITH INSERTING DRUM

This application is a continuation of application Ser. No. 07/936,701, filed Aug. 31, 1992 now abandoned.

FIELD OF THE INVENTION

The invention relates to a procedure for producing printed products of many pages with longitudinal and cross folded and a web-fed rotary printing press for carrying out this procedure.

DESCRIPTION OF THE PRIOR ART

Web-fed rotary printing presses for producing printed products of many pages are known in different constructions. Especially in the U.S.A prior art discloses that there are rotary printing presses of up to nine or ten paper webs each of a width of four plates running into one folder having two, four or six formers. Before that, the paper webs pass printing units for single-colour or multi-colour perfecting. In this respect, it is common to use four plates over the width and two plates (broadsheet) on the circumference resulting in once 16 pages for collect-run production per paper web or in twice eight pages for double production per plate cylinder revolution.

In the U.S.A. but in Europe as well double production is mostly preferred. Then the maximal number of pages is 80 for a 10-web-production. Consequently, there will be a printed product of four sections (called books, too) each of 20 pages or total 80 pages by using four formers regularly.

Currently, only one American newspaper is sometimes printed with maximal twelve paper webs and six formers resulting in $12\times8=96$-page-strong news products out of the folder in uncollected production.

The experience made during production shows that the net output—that means the average products printed/hour—on such hudge presses is the worse the more paper webs simultaneously run into one single folder. It is known that a 80-page-product is produced more preferable in a 5-paper web run in collect-run production instead of with ten paper webs in double production because there are half as much possibilities of failures such as web tension problems, faulty pastings etc. As a result, the production staff prefers collect-run production which, however, is refused by the editorial staff as there is less flexibility regarding the newspaper layout at collect-run production. On one hand the result is a page count multiple of four, i.e. it is possible to produce only newspapers of 80, 76, 72, 68, . . . etc. pages in contrast to the page count multiple of two for double production of 80, 78, 76, 74, 72, . . . etc. pages. On the other hand in principle it is possible to have only so many different sections in the product as there are formers used for production. For four sections only two formers can be used for collect-run production so that only two different numbers of pages will be created for four sections, i.e. section A is identical to section C—f. ex. 24 pages—and section B is identical to section D—equal 16 pages—for totally 80 pages. The editorial staff feels itself restricted as for a present number of total pages it is capable of freely fixing the number of pages of the first section only—then the remaining three numbers of sections are fixed and are even the same crosswise.

At double production of f. ex. four sections all numbers of pages of the sections are freely choosable in the page count multiple of two with one restriction that the total number of pages of all sections results in f. ex. 80 pages.

Through the U.S. Pat. No. 3,822,877 an inserting drum has become known.

SUMMARY OF THE INVENTION

It is an object of the invention to create a procedure for producing printing copies (printed products) of a large number of pages and a web-fed rotary printing press for carrying out the procedure enabling short distances of the paper web and a reduction of the number of paper webs printed running into one folder for producing printed copies of a large number of pages.

Printed products, f. ex. newspapers, directories or parts of them, may be produced in a preferable manner in uncollected, that means in double production of a much higher net output than this was possible before. Moreover, the limit of maximal 80 pages or in individual cases of 96 pages of printed products (broadsheets) produced in double production in a web-fed rotary printing press may considerably be amended upward while simultaneously reducing the number of paper webs of a usual web-width. The number of paper webs running into a folder is considerably reduced resulting in an increased net output although printing units of a width of more than four news pages, for example six plates over the width, and conventional folders may be used.

The paper webs required to obtain the number of pages requested are printed in uncollect-run production in the web-fed rotary printing press in which the paper webs, however, are split up to two or more folders running synchronously and the copy stream folded leaving each folder is gathered to a single copy stream by means of an inserting drum known synchronously driven by the web-fed rotary printing press to be conveyed from it.

According to the invention the web-fed rotary printing press removes difficulties known at the moment, increases the range of productions, simplifies the production and considerably reduces the risk for the newspaper production taken by operators, manufacturers and designers of huge presses.

The advantages of the invention will be explained on the following example. The difficult 12-web-run for a 96-page-production uncollected would result in a nearly impossible 16-web-run for a 128-page-production with a very restricted net output caused by so many webs. According to the invention 16 webs do not run into one single folder, but eight webs each run into one folder of its own. Thus the total web-fed rotary printing press is divided into two "complete" press sections of each eight webs with each one folder. Each 8-web-section may be maderready separately in a preferable manner and there are short and symmetrical paper distances in an arrangement of each press with four printing towers, folder and four reel stands. As regards the web tension each of these press sections is capable of being started-up and controlled much more easily with eight webs only than with 16 webs. After having maderready the press sections to be ready to run the longitudinal shafts are engaged, i. e. both presses become a total web-fed rotary printing press running synchronously with one press man. In a preferable manner there is an inserting drun known of two input and one output station only driven by the longitudinal shaft via a gear box and arranged between the two press sections. By means of for example timed conveyors known two copy streams of each 64-page-newspapers in double production are conveyed from two folders running synchronously to the inserting drum running synchronously on short distances and gathered to a copy of 128 pages respectively in the inserting drum. Being inserted one copy stream of 123-page-copies in double production, i.e. of a page count multiple of two and of a speed of f. ex. 70,000 copies/h leaves—also transported by a timed conveyor—the press system to reach the mailroom for being completed with pre-prints, supplements etc. and packaged according to the usual methods.

Applying the classical methods—a 16-web-production in one gear folder and six formers—the example "double production or 128 broadsheets uncollected" would mean a new ground of risks hardly estimatable and certainly a very small net production of less than 40% of the net output. Such a press system would not be practical anymore and not economical, too.

On the contrary, according to the invention the procedure and the web-fed rotary printing press according to the invention solves the object of producing a 128-page-production in every respect. Prior art discloses an 8-web-production into one folder without bearing any new risks unknown. For that purpose both gear folders and in a preferable manner jaw folders ensuring a much higher folding exactness may be used. Inserting sections into other sections by means of inserting systems in a mail room located far away from the printing press has already been known for a long time as well. Prior art discloses that the main production—leaving the rotary printing press—is completed with pre-printed sections and supplements using modern inserting drums of a press output of up to 80,000 copies/h in double production.

In an inventory manner an inserting drum—it may even be simplified—is positioned between two rotary press sections running coupled through and mechanically driven, i. e. directly by the common press longitudinal shaft. As a result, the synchronous run of two rotary press sections with two folders and the corresponding number of reel stands with the inserting drum is ensured from the commands "forward inching" via "Faster", "Slower" to emergency stop.

Being an integrated part of the rotary printing press the inserting drum exclusively serves for producing one product and products of 96 and more pages with longitudinal and a cross fold, f. ex. a newspaper, and for enabling higher net outputs than before as the press has to run only half the number of webs per folder. The area of the invention also includes the possibility to arrange the inserting drum somewhat outside the common outline of the two or three press sections.

Pre-prints etc. are inserted in the mailroom as before for not transferring these complicated things into the press room.

DESCRIPTION OF PREFERRED EMBODIMENTS

Figure 1:
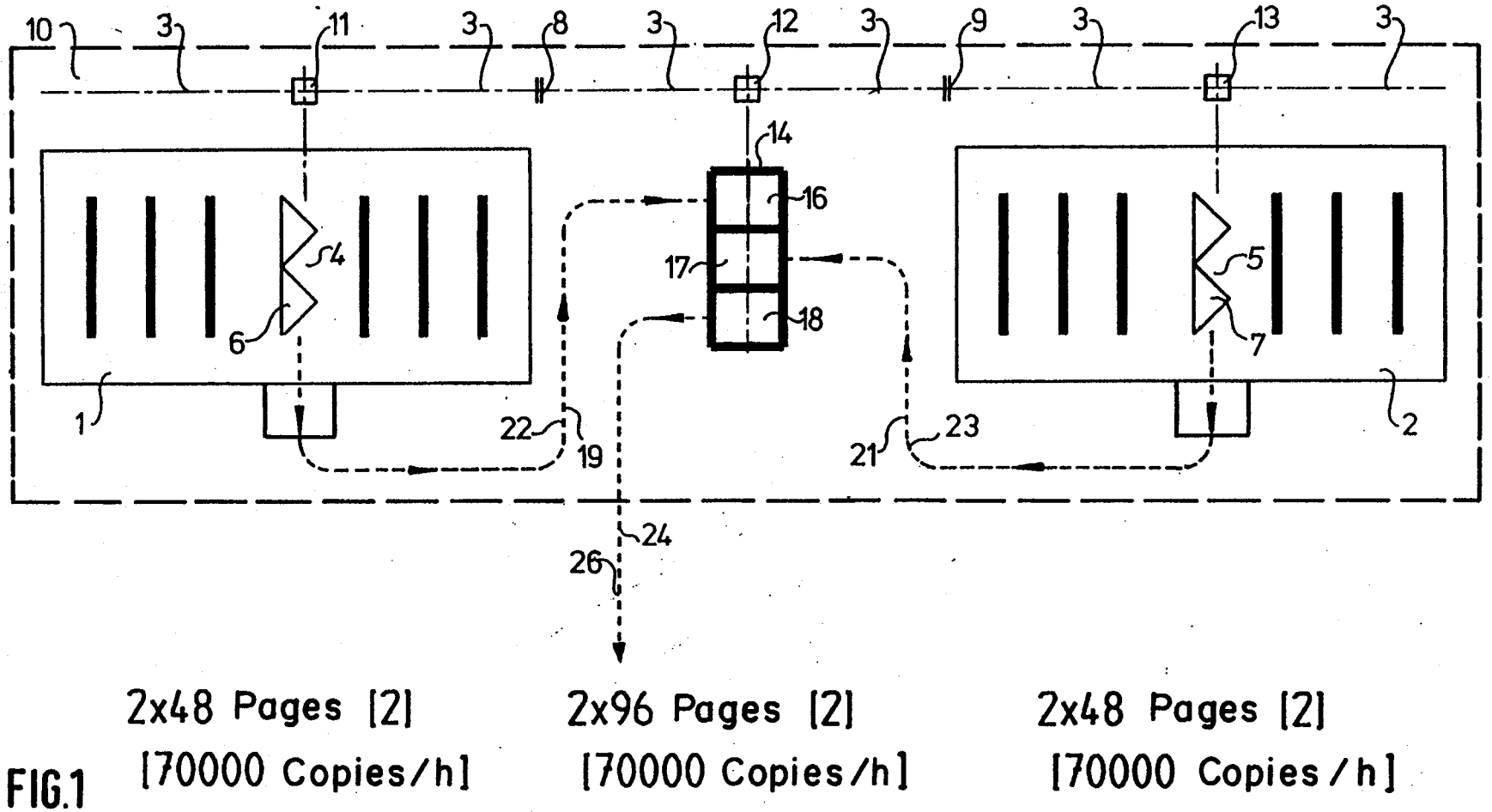
FIGS. 1 to 7 show three embodiments of a web-fed rotary printing press 10 according to the invention of each six reel stands, each six printing units for f. ex. 16 pages or 24 pages perfecting, each one folder 4; 5 of two or three formers 6; 7 effecting the former fold and gear or jaw folders and one or two deliveries.

In all embodiments 1 to 7 the web-fed rotary press sections 1, 2, 44—called press sections 1, 2, 44—as well as inserting drum 14, 47 are driven by each a dividing gear drive 11, 12, 13 by a longitudinal shaft 3 driven. In the longitudinal shaft train of longitudinal shaft 3 there are provided each a connectable coupling 8, 9, 20 between gear drives 11 and 12 for press section 1 and inserting drum 14 and between dividing gear drives 12 and 13 for press section 2 and inserting drum 14 and between dividing gear drives 11 and 15 for press section 1 and press section 44.

FIG. 1 shows a schematical web-fed rotary printing press 10 of two 6-web rotary web-fed presses 1 and 2 coupled through with a common longitudinal shaft 3 and connectable couplings 8, 9 and dividing gear drives 11, 12, 13 for separate operation during makeready and for common operating during production. Longitudinal shaft 3 also drives one inserting drum 14 of two input fields 16, 17 and one output station 18. It receives the section streams 19 from folder 4 via sectional timed conveyor 22 as well as section streams 21 from folder 5 via sectional timed conveyor 23 to gather them centrally to a complete printed copy 26. Sections 19, 21 leaving the left and right press section 1; 2 consisting f. ex. each of six printing units, paper reel stands, paper web leads and one folder 4, 6; 5, 7 producing in "uncollected" or "collect-run" production are gathered to a copy 26 and transported by a copy conveyor 24 into a mailroom.

As shown in FIG.1 and according to the invention the web-fed rotary printing press 1, 14, 2 runs uncollected, i.e. double production resulting in gross 70,000 copies/h at 35,000 cylinder revolutions. Press section 1 with folder 4 prints and folds 70,000 identical signatures/h of 48 pages in a page count multiple of two—i.e. a decreasing paper web width or number of webs enables the production of 48, 46, 44, 42, . . . etc. pages in two sections by using two formers 6; 7 effecting the length fold. The same applies for press section 2 with folder 5 rotating synchronously with folder 4. Due to a mechanical connection with longitudinal shaft 3 and dividing gear drive 12 inserting drum 14 runs synchronously, too and practically belongs to folders 4 and 5 serving the exclusive purpose to gather the two section streams 19 and 21 to products 26 of each 96 pages in a page count multiple of two to be guided by a timed conveyor 24 to the mailroom. Consequently, the two 96-page products 26 consist of four sections due to the two folders 6 and 7 respectively.

Figure 2:
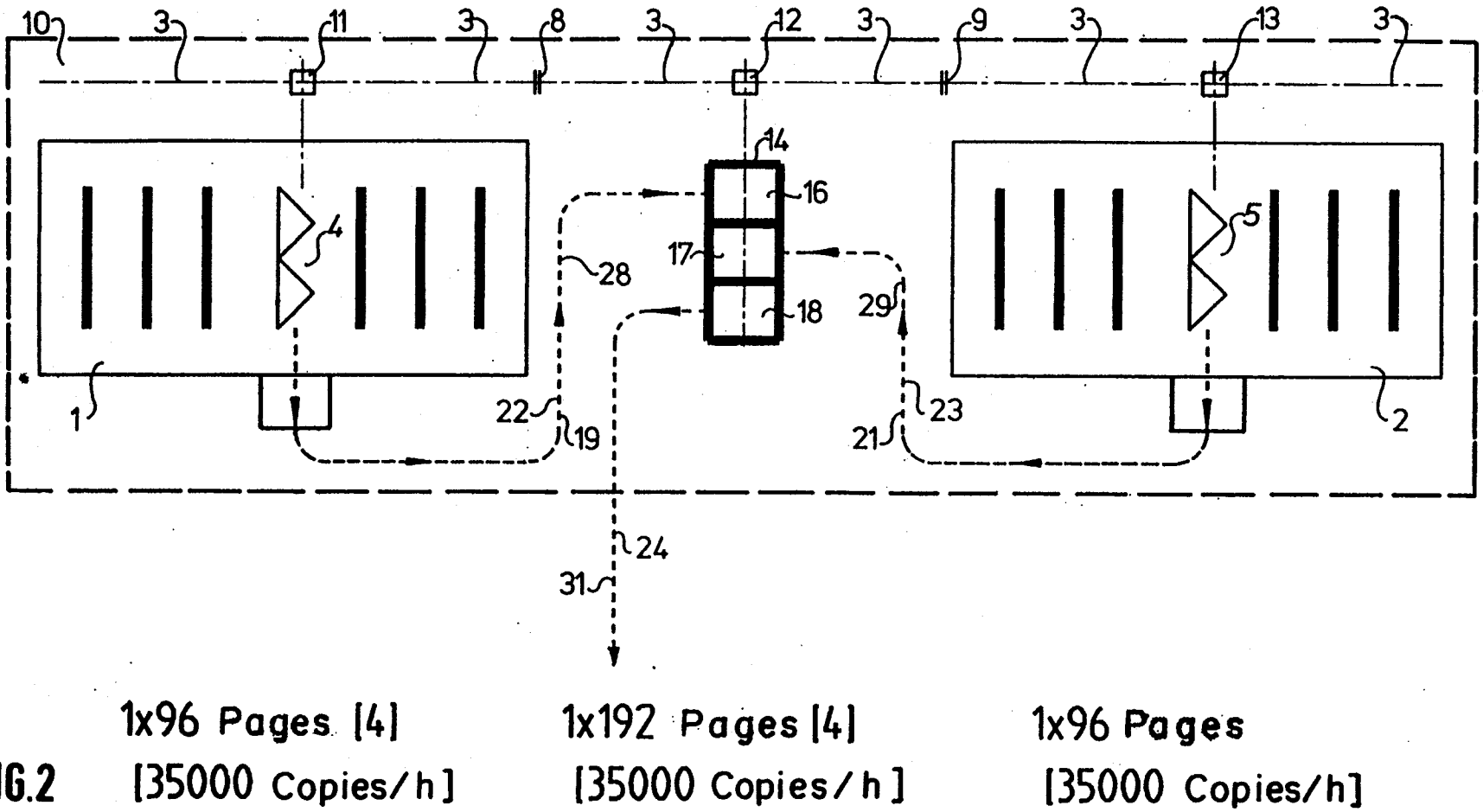

In FIG. 2 the web-fed rotary printing press 10, consisting of 1, 14 and 2 runs in collect-run production. Each press section 1 and 2 is able to produce maximal 35,000 sections 28, 29 respectively to 96 pages in a page count multiple of four, that means 96, 92, 88, 84, . . . etc. pages. Due to the mechanically imposed synchronous run by means of longitudinal shaft 3 of press section 1 with folder 4, press section 2 with folder 5 and inserting drum 14 both section streams 19, 21 coming from sections 28, 29 each of maximal 96 pages and each four sections are gathered to a product stream 31 of 35,000 products per hour of products with maximal 192 pages of eight sections in a page count multiple of four.

Figure 3:
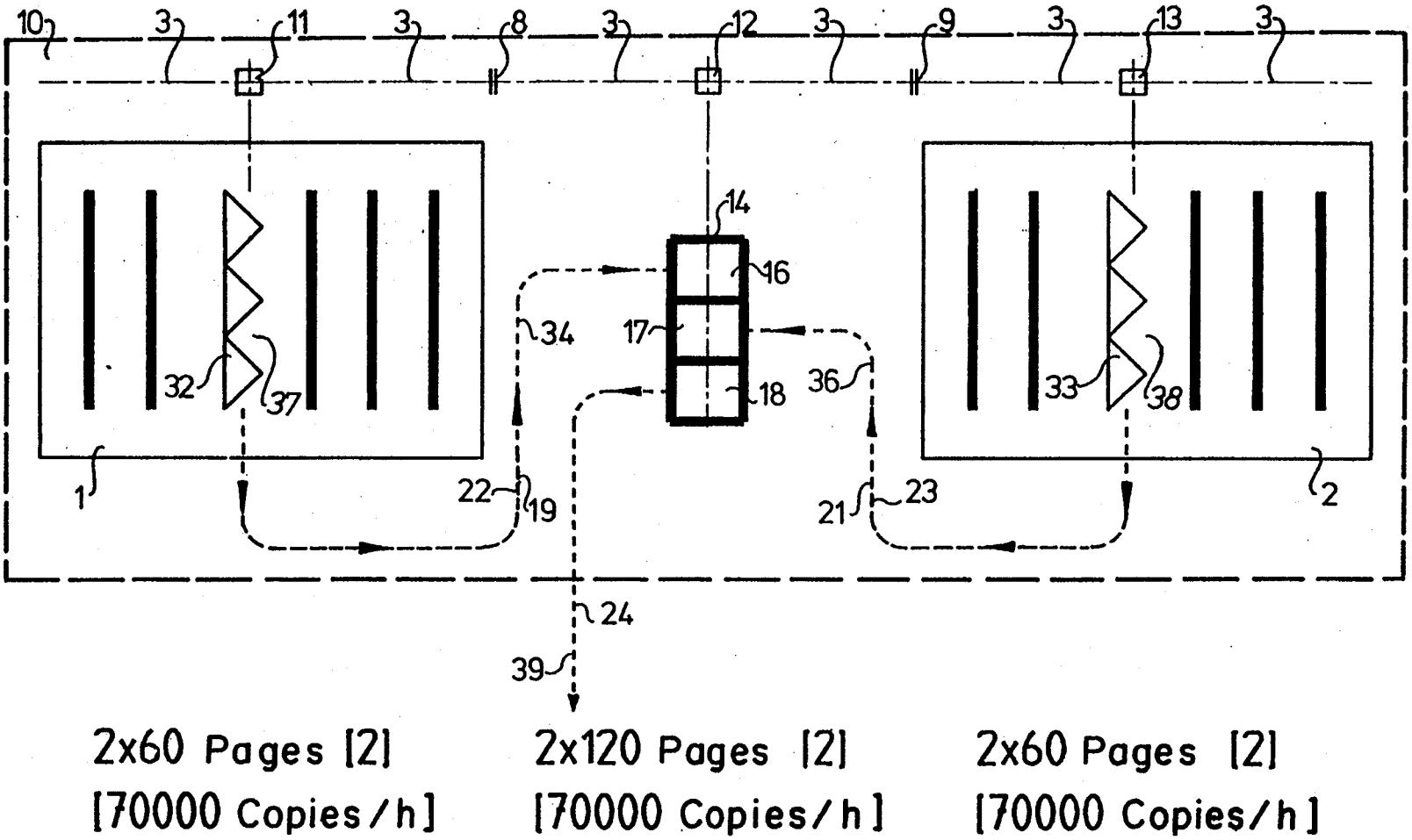

FIG. 3 shows a web-fed rotary printing press 10 for products of 120 pages in uncollected production using a conventional technique which could not be realized up to now for which 15 pieces of 4-page-wide webs must run into one gear folder simultaneously. The inventory separation of the production on two press sections 1 and 2 with their own gear or jaw folders 37 and 38 of each three formers 32, 33 and one inserting drum 14 renders all easier possible. Instead of 4-plate-wide papere uses 6-plate-wide webs and printing units of about 2 m (80") web-width. Then totally ten webs are sufficient for a 120-page-production, or split up on two press sections 1, 2 printing each only five webs for a partial production of twice 60 page-strong sections of 70,000 sections per hour signifying ideal production conditions for press section 1 and press section 2 and thus high net output. After having gathered and inserted the two section streams 19, 21 of sections 24 and 36 of each 2×60 pages delivered by folders 37 and 38 of press section 1 and 2 into inserting drum 14 and press section 1 and 2 being coupled a product stream 39 of 70,000 products/h of two times 120 pages in a page count multiple of two with 3+3=6 sections leaves the complete web-fed rotary printing press 1, 14, 2 (FIG. 3).

Figure 4:
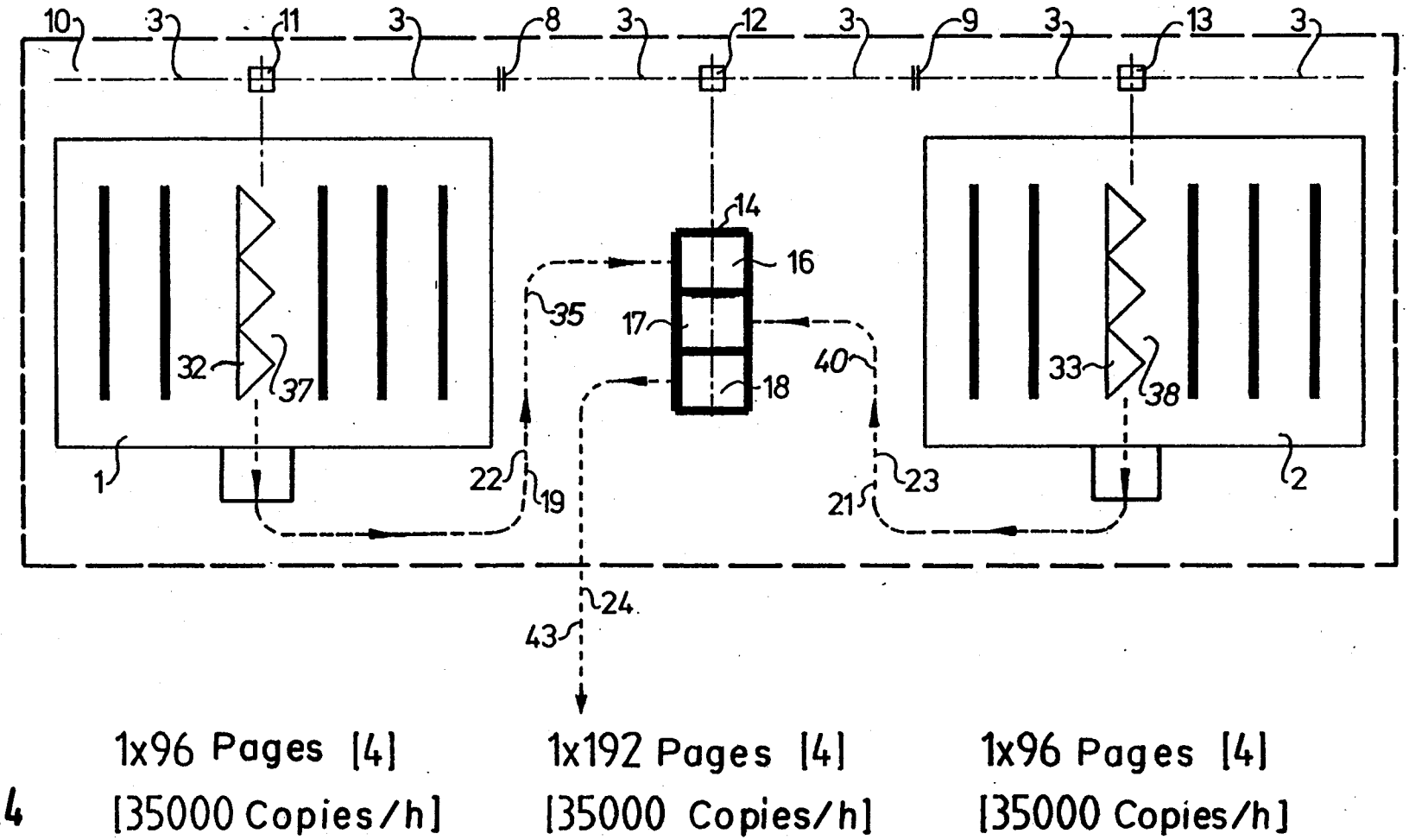

As shown in FIG. 3 and described in the following the same web-fed rotary printing press, 1, 14, 2, 37, 32, 38, 33—FIG. 4—produces in collect-run two section streams 19, 21 of sections 35, 40 of 35,000 signatures of 96 pages in a page count multiple of four and maximal six sections at 4-web-run by using jaw folders 37 and 38. Instead of jaw folders 37 and 38 gear folders would enable even 120 pages in a 5-web run per press section 1 and 2. Gathered in inserting drum 14 it deliveries a product stream 43 of 35,000 products/h of 192 pages of maximal 12 sectionss in a page count multiple of four by using jaw folders folding accurately or 35,000 products/h of 240 pages at 5-web run in each press section 1, 2 by using gear folders and common longitudinal shaft 3 coupled through during production.

Figure 5:
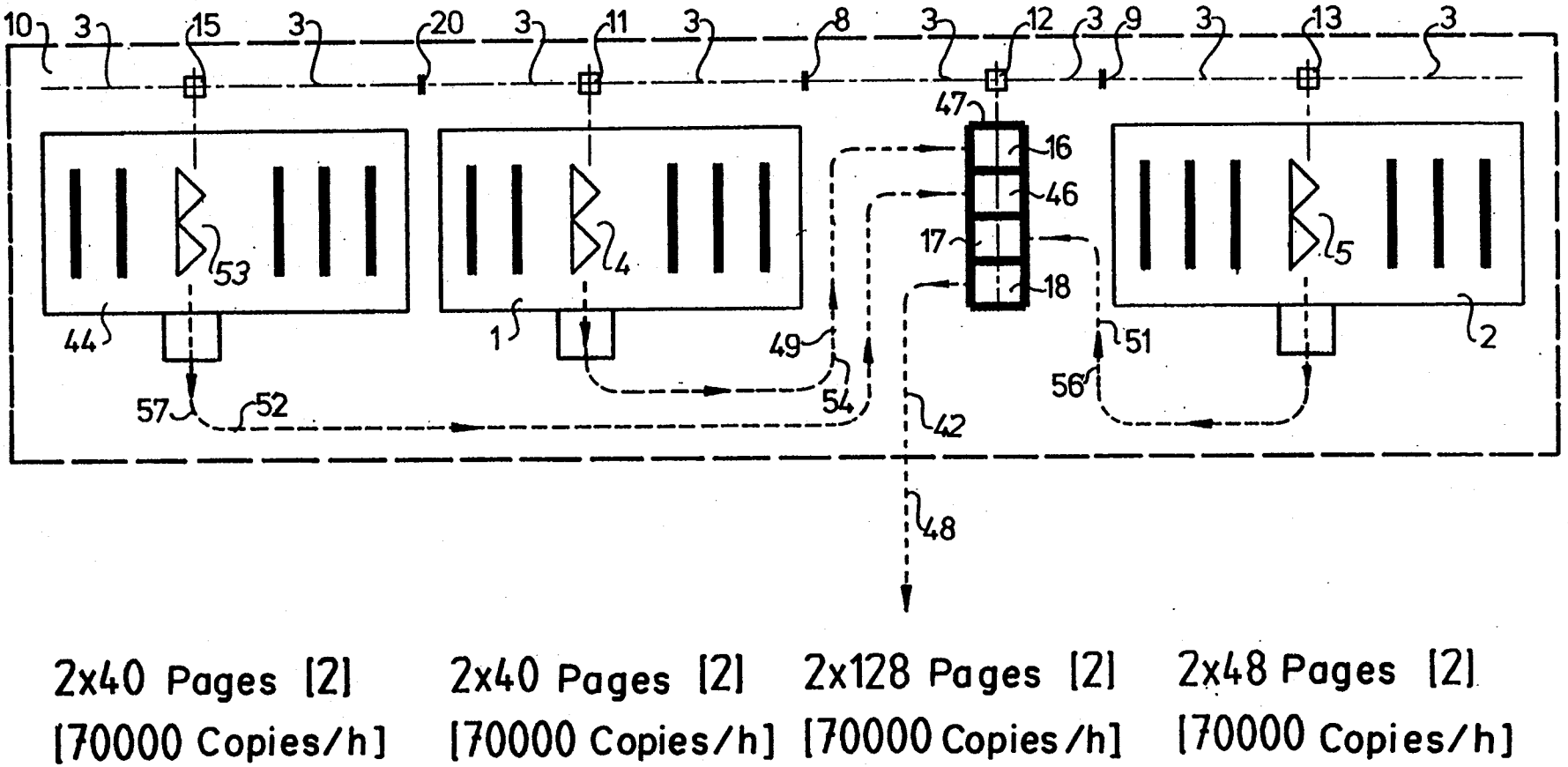

FIG. 5 clearly shows that even more than two, namely f. ex. three press sections 1, 2, 44 are capable of producing 70,000 copies/h of twice 40 and once 48 pages at twice 5-web run and once 6-web-run 4-page wide and uncollected. Running synchronously by means of longitudinal shaft 3 coupled also driving an inserting drum 47 of three input fields 16, 17, 46 and one output station 18, being inserted 70,000 copies/h of twice (40+40+48=) 128 pages of six sections and in a page count multiple of two leave the complete press system 10 by means of timed conveyor 48 to the mailroom. The individual timed conveyors 49, 51, 52 of press sections 1, 2, 44 may be switched over, if necessary, in such a way that in uncoupled run three product streams 54, 57, 56 may then be conveyed directly to the mailroom for further handling. In this case the three printing presses 1, 2, 44 are self-sufficient and inserting drum 47 is stopped.

Figure 6:
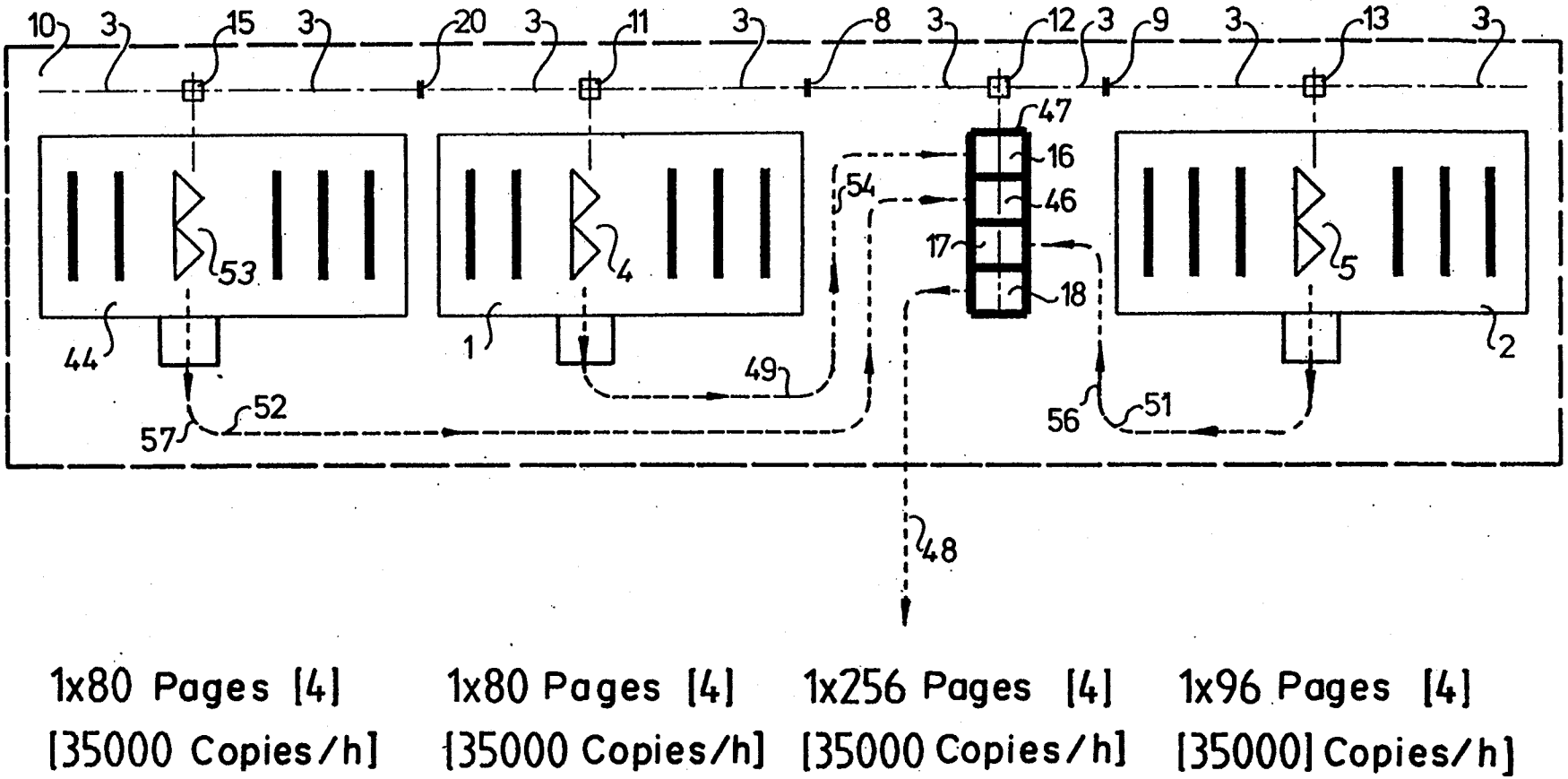

FIG. 6 explaines the production "collect-run" of the web-fed rotary printing press 10 as per FIG. 5.

If on a web-fed rotary printing press described in FIG. 5 gear or jaw folders 4, 5 or 53 run in collect-run production the third press section 44 produces a signature stream 57 of maximal 1×80 pages, press section 1 produces a signature stream 54 of 1×80 pages and press section 2 produces a signature stream 54 of 1×96 pages at each five webs on press section 44 and 1 and six webs on press section 2. The individual timed conveyors 52, 49 and 51 transport the signature streams 54, 56, 57 to inserting drum 47 with its three input fields 16, 17, 46 permanently producing copies of 256 pages to be transported via timed conveyor 48 to the mailroom (as shown in FIG. 6).

When press sections 1, 2 run individually (self-sufficient run) inserting drum 14 is stopped and the complete products 19, 21, f. ex. newspapers, will not be delivered here into inserting drum 14 but remain in the timed conveyors 49, 51 up to the mailroom while conveyor 24 for main products 41 gathered as well as inserting drum 14 are stationary.

It is also possible to save conveyor 24 and to connect the output station of the inserting drum 14 operating to an individual timed conveyor 49 or 51 idling behind inserting drum 14 for transporting the products gathered to the mailroom.

Figure 7:
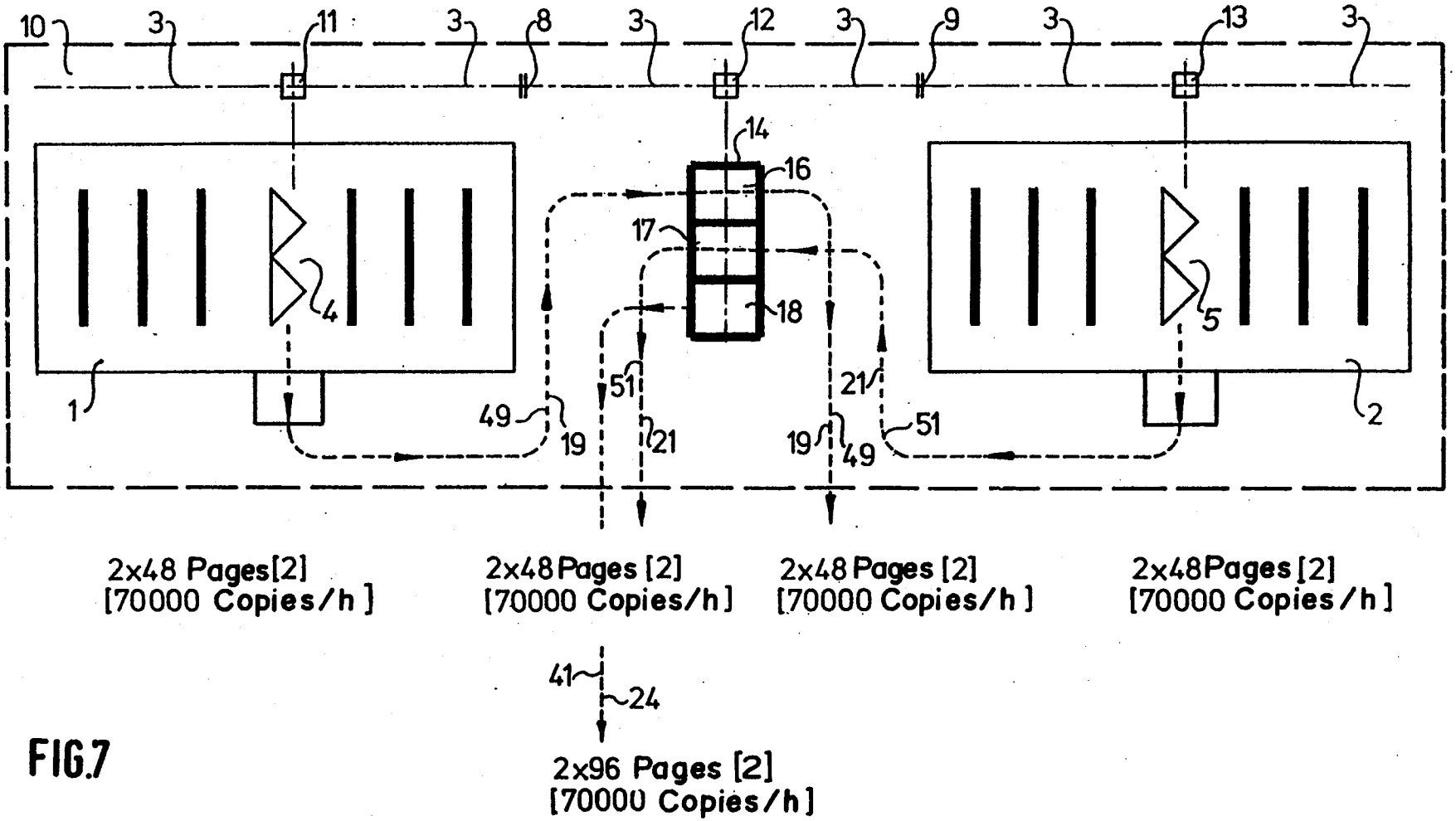

FIG. 7 shows another effective solution if press sections 1, 2 on one hand produce separately f. ex. preprints to deliver copy streams by means of timed conveyors to the mailroom and on the other hand they produce thick main products in a coupled status. Here timed conveyors 49; 51 of each press section 1, 2 are guided via inserting drum 14 to the mailroom. During a run coupled through both conveyors 49, 51 transport sections 19, 21 into inserting drum 14 running synchronously and then run idle. Afterwards, the main products 41 gathered are transported by means of timed conveyor 24 to the mailroom.

The invention is not limited to these examples for application. Thus inserting drum 14, 47 may also be driven synchronously to the press sections 1, 2, 44 coupled through by means of an electric shaft. If press sections 1, 2, 44 shall be separated f. ex. for printing preprints including supplements and shall run coupled through for producing the copy an own inserting drum 14, 47 may also be associated to each press section 1, 2, 44 in the known manner in the mailroom. During a run coupled through the timed conveyors are switched over to one inserting drum 14, 47 in the mailroom for producing the copy by two or more press sections running synchronously.

For producing thick copies with the fewest possible number of webs, f. ex. according to FIG. 1 and 2, it is further possible to have press section 2 produced in collect-run 35,000 signatures/h of 96 pages in a page count multiple of four. At the same time press section 1 produces uncollected, i.e. 70,000 signatures/h of 48 pages in a page count multiple of two.

As the paper webs of press section 2 run into folder 5 of its own and is nothing to do with press section 2 and folder 4, the synchronous run of all webs, i. e. the same paper web speeds, is not important at all. It is rather required that the cycle of the sections exactly coincides for inserting. For that reason collect-run production by press section 2 and double production by press section 1 may be gathered in inserting drum 14 if press section 1 running double production is switched to half number of revolutions in gear box 11 by means of gear drive 1:2 representing a another embodiment of the invention. Then press section 1 does not produce 70,000 signatures/h but 35,000 signatures/h of 48 pages in a page count multiple of two. After inserting timed conveyor 24 receives 35,000 products/h of 144 pages in a page count multiple of two, i. e. 144, 142, 140, 138, etc. in six sections of which 1, 2, 3, 4 are freely choosable while section 5 has the same number of pages as section 3 and section has the same number of pages as section 4 due to partial collect-run. As a result, there are certain restrictions of possible number of pages which may be dropped if one do without any collect-run production.

To summarize the classical large web-fed rotary printing press of one gear folder and the infeed of f. ex. twelve paper webs into six balloon formers for double production of the folder of 96 pages in six sections is replaced by twelve paper webs preferably divided on two jaw folders of each three formers and six paper web infeeds per folder plus one inserting drum for gathering the signature streams of the folders. Like the solution by means of a gear folder according to the invention the web-fed rotary printing press delivers a product stream of 96-page products of six sections in the direction of the mailroom for further handling.

According to the invention, however, the solution additionally requires another folder and an inserting drum in the web-fed rotary printing press. But this additional expenditure is compensated by a considerably higher net output and the serious advantages of twice 6-web-run into each a folder compared with a 12-web-run per folder. Paper tensions on six webs are controlled much easier than on twelve webs and markeready is faster. Instead of gear folders fast running jaw folders may be used in a preferable manner ensuring accurate folding for all running speeds, i.e. there is no displaced fold in case of speed amendments.

The average net output of a web-fed rotary printing press of twelve-webs running into one folder is about 40 rated speed, the net output of a rotary printing press of six webs running into the folder is about 60%. According to the invention the web-fed rotary printing press produces net about 50% more newspapers per hour.

If for example 75,000 copies/h of 96 pages are to be produced net only two web-fed rotary printing presses 10 will have to be used in a preferable manner according to the invention, i.e. totally 24 reel stands, 24 printing towers, four folders and two inserting drums as each press 10 will then produce 60% of 70,000 products/h=42,000 products.

A printing press of a present design produces net 40% of 70,000 products/h=28,000 products/h of 96 pages. Consequently, today three web-fed rotary printing presses of totally 36 reel stands, 36 printing towers and gear folders are required.

This comparison of output evidently shows enormous economical advantages of the solution according to the invention concerning costs of purchase, staff and operating costs, dimensions of foundation and press room, maintenance and others.

| Parts list |
|---|
| 1 Press section, first |
| 2 Press section, second |
| 3 Longitudinal shaft |
| 4 Folder |
| 5 Folder |
| 6 Former |
| 7 Former |
| 8 Coupling, switchable |
| 9 Coupling, switchable |
| 10 Web-fed rotary printing press |
| 11 Dividing gear drive |
| 12 Dividing gear drive |
| 13 Dividing gear drive |
| 14 Inserting drum |
| 15 Dividing gear drive |
| 16 Input field (14, 47) |
| 17 Input field (14, 47) |
| 18 Output station (14, 47) |
| 19 Section stream (2 × 48 pages, 1 × 96 pages, 2 × 60 pages) |
| 20 Coupling, switchable |
| 21 Section stream (2 × 48 pages, 1 × 96 pages, 2 × 60 pages) |
| 22 Sections - timed conveyor |
| 23 Sections - timed conveyor |
| 24 Sections - timed conveyor |
| 25 — |
| 26 Products (96 pages) |
| 27 — |
| 28 Sections (96 pages) |
| 29 Sections (96 pages) |
| 30 — |
| 31 Product stream (192 pages) |
| 32 Former |
| 33 Former |
| 34 Sections (60 pages) |
| 35 Sections (96 pages) |
| 36 Sections (60 pages) |
| 37 Gear or jaw folder |
| 38 Gear or jaw folder |
| 39 Product stream (120 pages) |
| 40 Sections (96 pages) |
| 41 Main products |
| 42 Products |
| 43 Product stream (192 pages) |
| 44 Press section, third |
| 45 — |
| 46 Input field |
| 47 Inserting drum |
| 48 Timed conveyor |
| 49 Individual timed conveyor |
| 50 — |
| 51 Individual timed conveyor |
| 52 Individual timed conveyor |
| 53 Folder |
| 54 Signature stream (2 × 40 pages, 1 × 80 pages) |
| 55 — |
| 56 Signature stream (2 × 48 pages, 1 × 96 pages) |
| 57 Signature stream (2 × 40 pages, 1 × 80 pages) |
| 58 — |
| 59 — |
| 60 — |

I claim:

1. A method for producing a multiple page printed product, such as a newspaper, comprising the steps of:

providing a first web-fed rotary printing press section having a plurality of first printing units;

operating said first printing press section to produce a first group of printed webs;

providing a first paper web folder having at least two formers for synchronous operation with said first printing press section;

directing said first group of printed webs to said first paper web folder;

dividing said first group of printed webs between said at least two formers in said first paper web folder;

forming a first stream of folded and formed signatures in said first paper web folder;

placing said first stream of signatures on a first timed conveyor;

providing a second web fed rotary printing press section having a plurality of second printing units;

operating said second printing press section in synchronization with said first printing press section to produce a second group of printed webs;

providing a second paper web folder having at least two formers for synchronous operation with said second printing press section;

directing said second group of printed webs to said second paper web folder;

dividing said second group of printed webs between said at least two formers in said second paper web folder;

forming a second stream of folded and formed signatures in said second paper web folder;

placing said second stream of signatures on a second timed conveyor;

providing an inserting drum having at least first and second input fields;

positioning said inserting drum centrally between said first and second printing press sections;

operating said centrally positioned inserting drum in synchronization with said first and second printing press sections and said first and second paper web folders;

feeding said first stream of signatures from said first timed conveyor to said first input field;

feeding said second stream of signatures from said second timed conveyor to said second input field;

associating said first and second signatures in said centrally positioned inserting drum to form a complete printed product in an output station of said inserting drum; and delivering said complete printed product from said output station to a copy conveyor.

2. The method of producintg a multiple page printed product in accordance with claim 1 further including:

providing a third web fed rotary printing press section having a plurality of third printing units;

operating said third printing press section in synchronization with said first and second printing press sections to produce a third group of printed webs;

providing a third paper web folder having at least two formers for synchronous operation with said third printing press section;

directing said third group of printed webs to said third paper web folder;

dividing said third group of printed webs between said at least two formers in said paper web folder;

forming a third stream of folded and formed signatures in said third paper web folder;

placing said third stream of signatures on a third timed conveyor;

providing said centrally positioned inserting drum with a third input field;

directing said third stream of signatures to said third input field; and associating said third signatures with said first and second signatures in said centrally positioned inserting drum to form said complete printed product in said output station of said inserting drum.

3. The method of producing a multiple page printed product in accordance with claim 1 further including providing each of said first and second paper web folders with three formers.

* * * * *